US006592053B2

(12) United States Patent
Ericksen et al.

(10) Patent No.: US 6,592,053 B2
(45) Date of Patent: Jul. 15, 2003

(54) MISTING PLANT FOR EVAPORATIVE AIR COOLING

(75) Inventors: Kent C. Ericksen, Centerville, UT (US); Gary F. Wintering, Chandler, AZ (US)

(73) Assignee: Orbit Irrigation Products, Inc., North Salt Lake, UT (US)

( * ) Notice: Subject to any disclaimer, the term of this patent is extended or adjusted under 35 U.S.C. 154(b) by 0 days.

(21) Appl. No.: 09/928,846

(22) Filed: Aug. 12, 2001

(65) Prior Publication Data

US 2002/0074427 A1 Jun. 20, 2002

Related U.S. Application Data

(60) Provisional application No. 60/224,757, filed on Aug. 12, 2000.

(51) Int. Cl.[7] ..... B05B 1/00

(52) U.S. Cl. ..... 239/211; 239/16; 239/17; 239/289

(58) Field of Search ..... 239/16, 17, 211, 239/289; D23/213, 214, 215, 221, 222; 222/78

(56) References Cited

U.S. PATENT DOCUMENTS

| | | | | | |
|---|---|---|---|---|---|
| 1,989,525 | A | * | 1/1935 | Moore | 239/211 |
| D95,443 | S | * | 4/1935 | McCormick | |
| D100,087 | S | * | 6/1936 | Butt | |
| D153,334 | S | * | 4/1949 | Beaver | |
| 2,611,645 | A | * | 9/1952 | Forman | 239/211 |
| 3,944,138 | A | | 3/1976 | Easton | |
| 4,347,980 | A | | 9/1982 | Seki | |
| 5,224,652 | A | * | 7/1993 | Kessler | 239/211 |
| 6,202,937 | B1 | * | 3/2001 | King | 239/17 |
| 6,250,565 | B1 | * | 6/2001 | Ogie et al. | 239/211 |

* cited by examiner

*Primary Examiner*—Robin O. Evans
(74) *Attorney, Agent, or Firm*—Mallinckrodt & Mallinckrodt; Robert R. Ma-linckrodt

(57) ABSTRACT

An evaporative cooling unit that sprays a water mist into the air to cool the air by evaporation of the water mist is disguised as to its function and purpose by including the misting nozzles and water supply conduits in a decorative structure, such as an artificial flower arrangement or plant. The misting unit of the invention includes a base and a decorative structure extending from the base. A water conduit extends through the base from a base end with a fitting for attachment to a source of pressurized water such as a garden hose, into the decorative structure where it ends in at least one decorative structure end with a misting nozzle thereon. The base may take the form of a flower pot with the decorative structure taking the form of flowers or a plant extending from the flower pot.

7 Claims, 6 Drawing Sheets

MISTING PLANT FOR EVAPORATIVE AIR COOLING

RELATED APPLICATIONS

Figure 1:
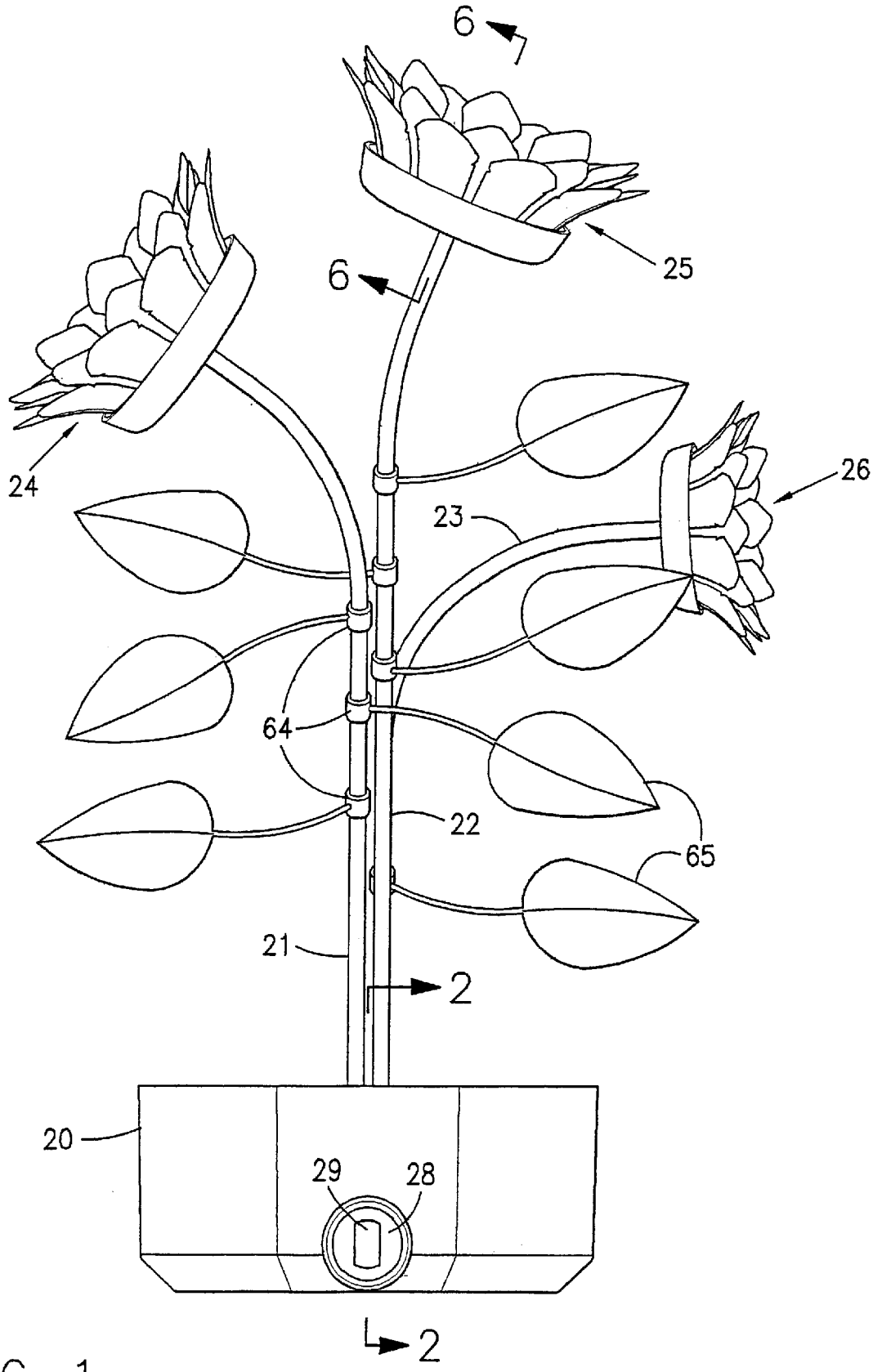

This application claims the benefit of Provisional Application Ser. No. 60/224,757, filed Aug. 12, 2000, and entitled Misting Plant For Evaporative Cooling.

BACKGROUND OF THE INVENTION

1. Field

The invention is in the field of evaporative air cooling devices for spraying a fine mist of water into the air to cool the air upon evaporation thereof 2. State of the Art Evaporative air cooling units spray a fine mist of water into the air which mist removes heat from the air as the water evaporates. Such cooling units are commonly used in commercial applications as well as in personal applications such as cooling units carried by backpackers. The mist nozzles used on such cooling units vary, with one type being the type disclosed in my copending application Ser. No. 09/415,343 (Ericksen only) for "Mist Nozzle for Evaporative Air Cooling Units" which is hereby incorporated by reference.

Such evaporative air cooling units are typically not pleasing to the eye to look at. There is a need for an evaporative air cooling unit which is pleasant to look at and which is disguised or wherein the misting nozzles are hidden from view.

SUMMARY OF THE INVENTION

An evaporative cooling unit that can be placed on a porch, patio, or beside a pool to supply cooled air to persons and animals in close proximity thereto is disguised as a plant or flower. The unit will be referred to herein as a misting plant.

The misting plant comprises a base, an upstanding decorative structure typically in the form of a plant or flower, a water conduit, and a mist nozzle. The decorative structure is connected to the base which supports such decorative structure in a substantially upright position. The water conduit includes a lower portion attachable to a water supply such as a water spigot or garden hose and which typically extends into the base, and an upper portion which extends through the decorative structure terminating at one or more misting nozzles attached to the decorative structure. When water is turned on, a fine mist is emitted from each misting nozzle to cool the ambient air by evaporative cooling.

In a first embodiment, the misting plant includes a base in the form of a flower pot having a lower portion of the water conduit in the form of an integral piping assembly connectable to a garden hose. The decorative structure comprises an upright water supply tube with an artificial flower with misting nozzle therein attached to the upper end of the water supply tube. A lower end of the water supply tube is connected to the piping assembly of the base to receive water therefrom. Where flexible tubing is used for the upright water supply tube, the tube can include a bendable or malleable stiffener wire disposed within the water supply tube to make it rigid enough to stand up on its own, support a flower at the upper end thereof, and allow bending thereof for a more natural look and to aim the nozzle so as to supply water mist in the desired direction. Further enhancements include a plurality of leaves disposed along the water supply tube, and one or more artificial stalks typically having an internal wire for bending to the desired position with non-misting flowers and leaves also extending from the base.

A second embodiment of misting plant includes a base in the form of a flower pot with a hole in the side thereof. A water conduit in the form of a flexible water supply tube having a lower portion with an end fitting connectable to a garden hose extends through the hole. The upper portion extends upwardly from within the pot. The decorative structure comprises the upper portion of the water supply tube extending from the pot, and a misting flower attached to an upper end of the upper portion thereof. A mist nozzle is operatively connected to such upper end of the flexible water supply tube, typically by means of the misting flower, for emitting a fine spray of water. The second embodiment misting plant can further comprise a bendable stiffener wire disposed in the upper portion of the water supply tube to allow bending thereof for a more natural look and to aim the nozzle so as to supply water mist in the desired direction. Further enhancements include a plurality of leaves disposed along the water supply tube, and one or more artificial stalks with a non-misting flower and leaves also connected to the base.

A third embodiment misting plant includes a base in the form of a flower pot having a lower portion of the water conduit in the form of an integral piping assembly connectable to a garden hose. The decorative structure comprises a hollow, typically blow molded, armed cactus structure, or other molded decorative structure. An upper portion of the water conduit comprises an upright flexible water supply tube having a lower end which is connected to the piping assembly of the base to receive water therefrom. A mist nozzle is operatively connected to the upper end of the water supply tube through the wall of the cactus structure, for emitting a fine spray of water. The third embodiment misting plant can further comprise multiple water supply tubes and mist nozzles and/or misting flowers.

The misting flowers may each comprise a front core, a rear core, and one or more petal disks. In one embodiment, the front core includes a central receiving opening to receive and hold a rearwardly extending stem, and an integral rearwardly extending outer rim. In a second embodiment, the stem is integral with the remainder of the front core. The stem includes an annularly barbed end portion for securely receiving the upper end of the water supply tube. The rear core includes a center portion having a hole therethrough, and an integral frontwardly extending outer rim. The petal disks comprise a plurality of cloth petals connected together by an integral center ring portion having a center hole. Two petal disks are sandwiched between the front and rear cores, the rear core being frictionally retained in position by the stem. The mist nozzle threads into the center portion of the stem in the center of the front core.

Alternatively, the mist nozzle can be of the type which, rather than having external threads, has one or more annular barbs for directly engaging the upper end of the water supply tube. In such a situation, the front and rear cores have a center hole and there is no stem, or alternatively, only a shortened version thereof is present. The mist nozzle and the upper end of the water supply tube are retained by means of a frictional fit with the front and rear cores and stem.

THE DRAWINGS

Figure 3:
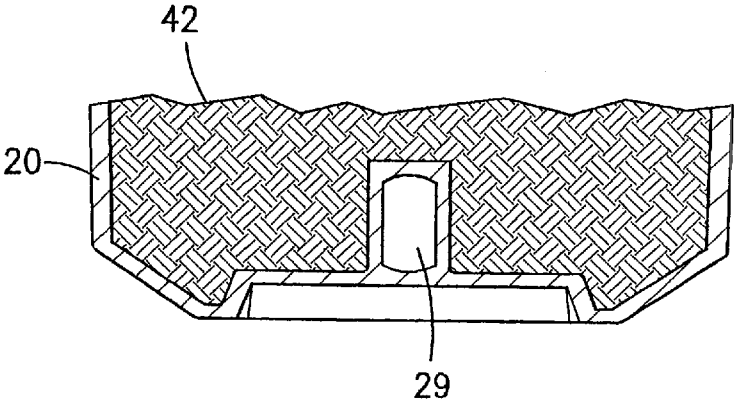
Figure 2:
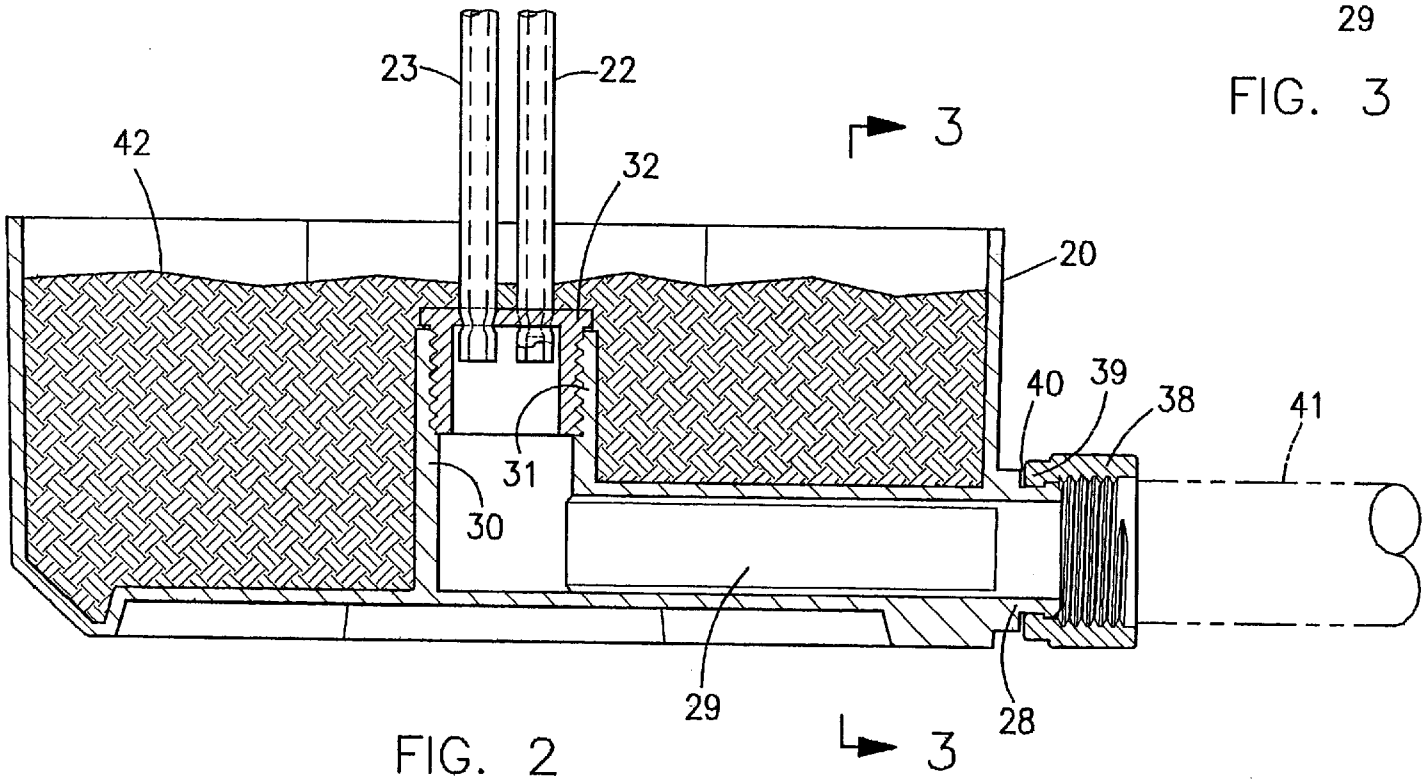
Figure 6:
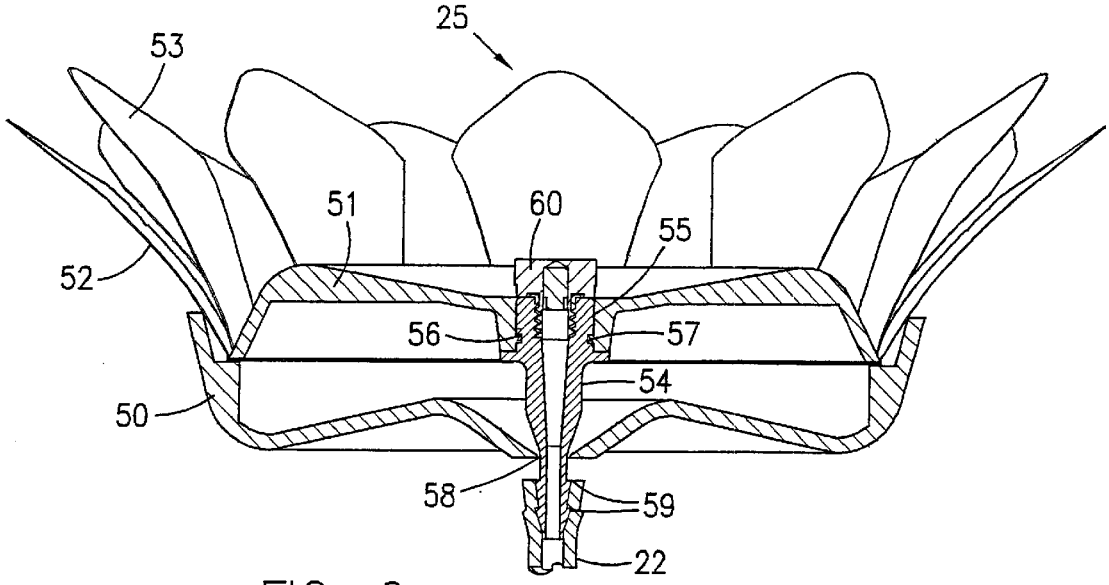
Figure 4:
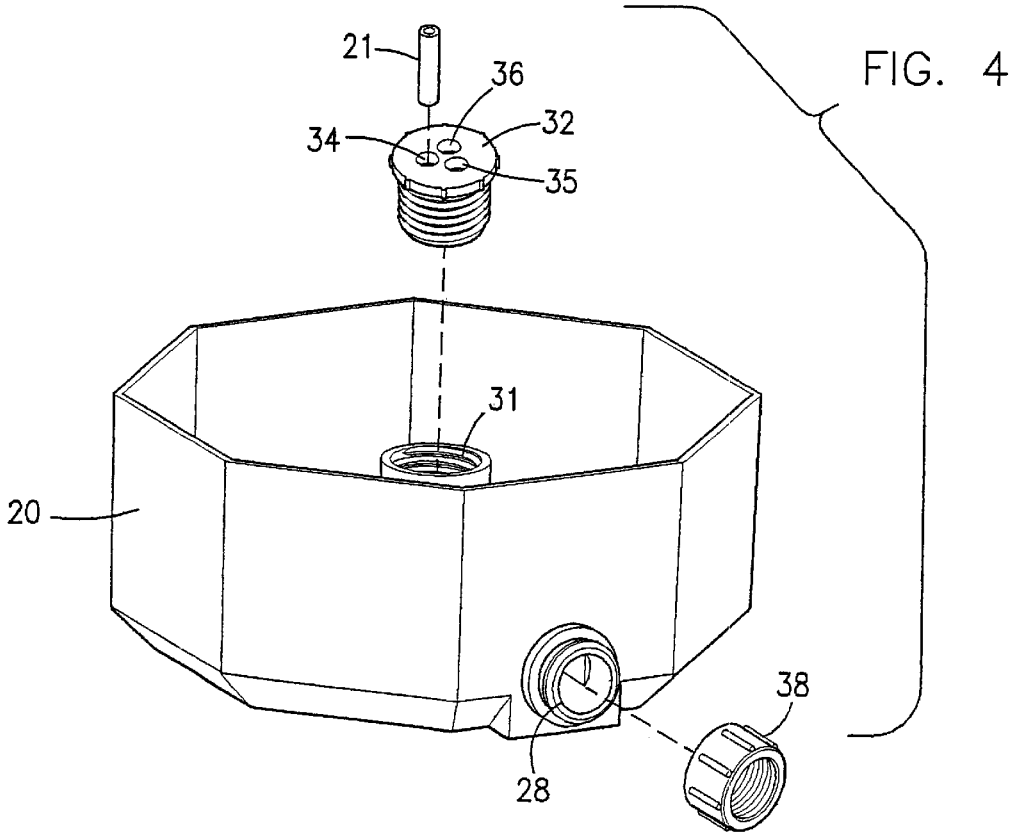
Figure 5:
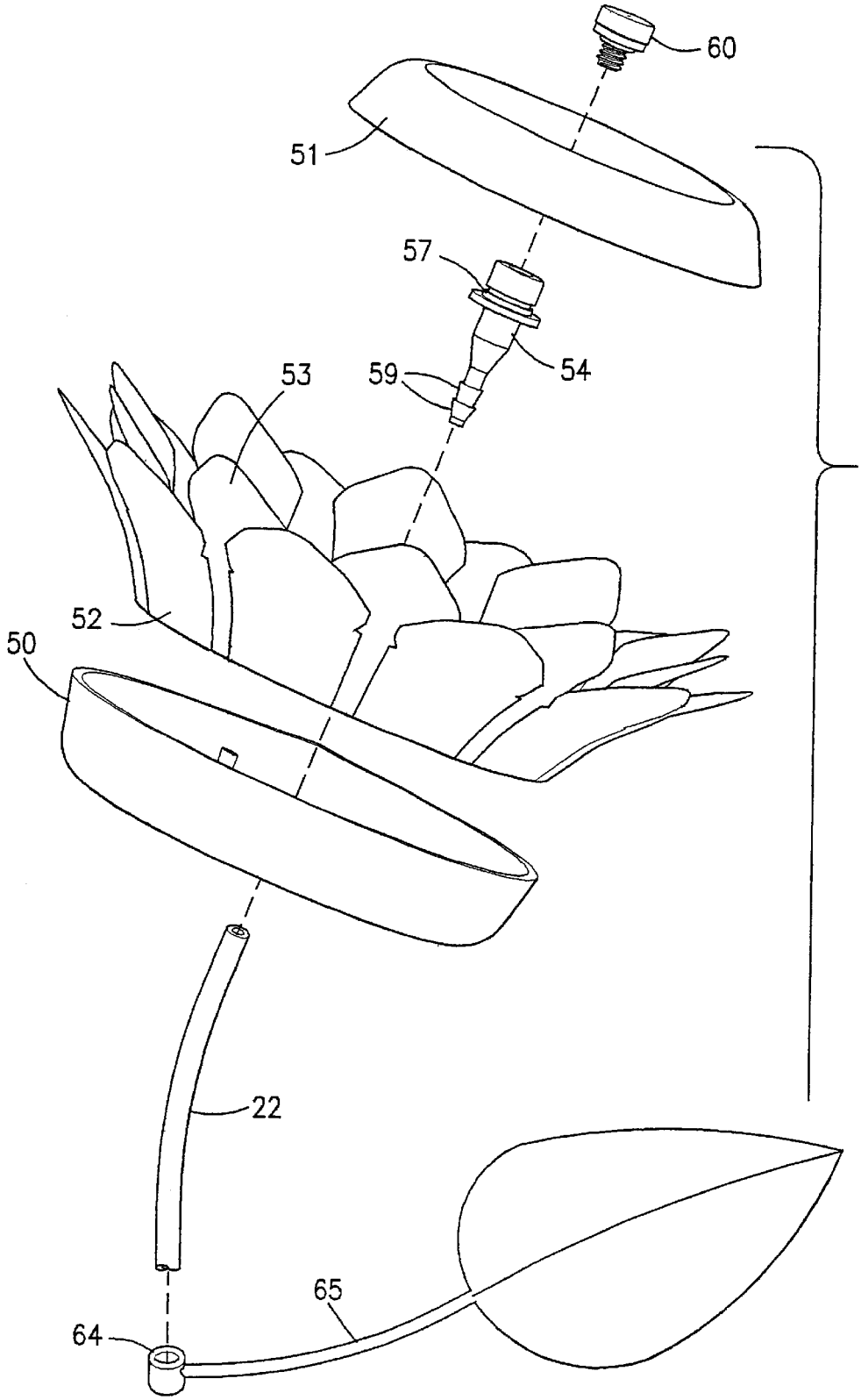
Figure 8:
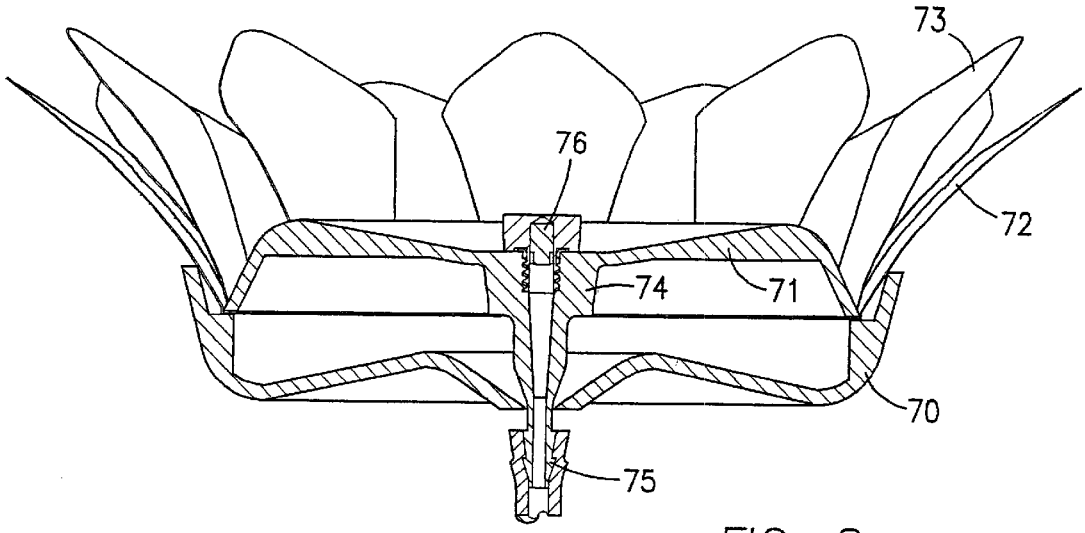
Figure 7:
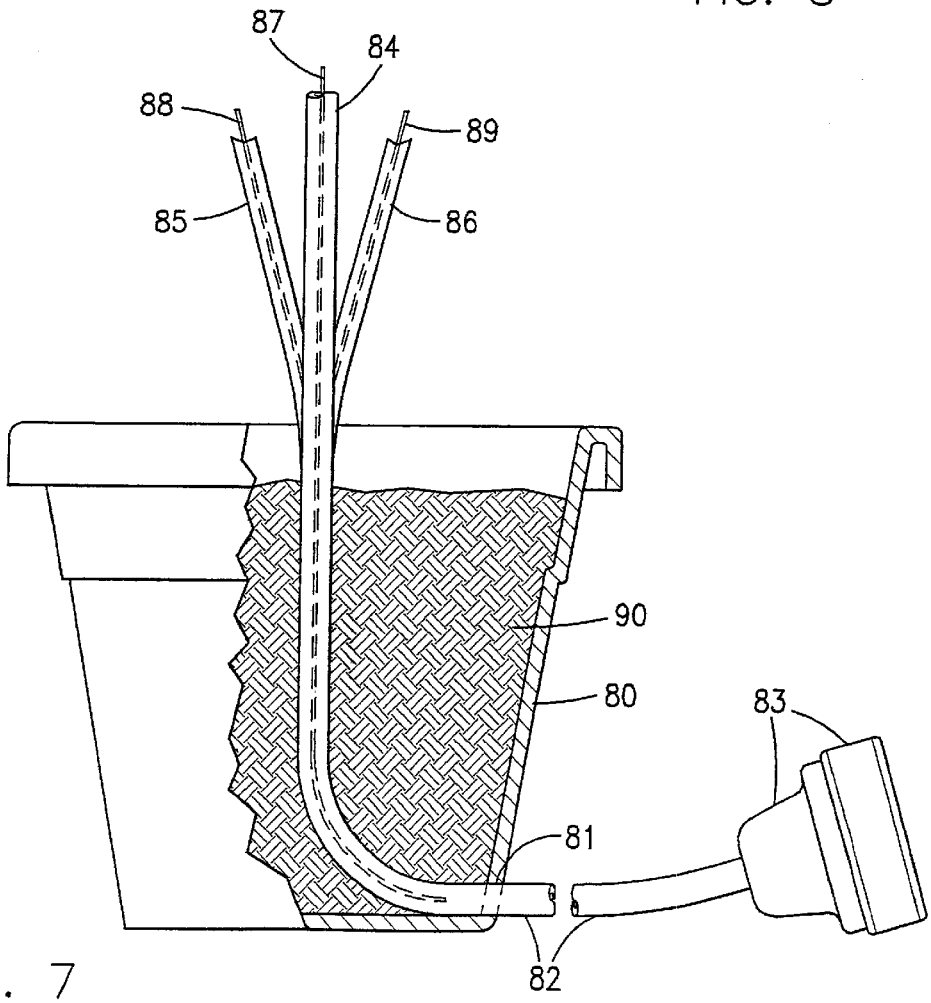
Figure 9:
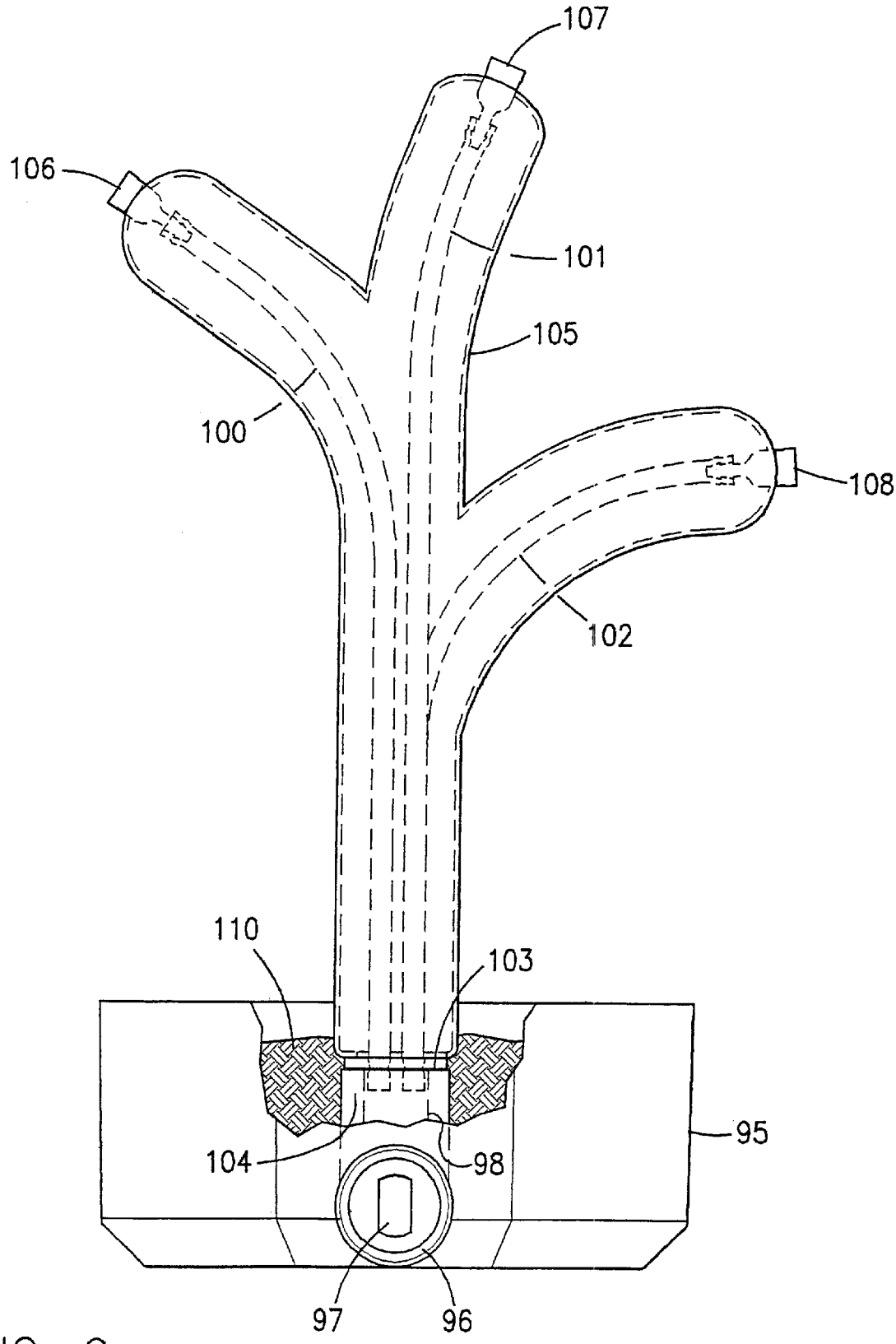

The best mode presently contemplated for carrying out the invention is illustrated in the accompanying drawings, in which:

FIG. 1 is a rear elevational view of an evaporative cooler of the invention;

FIG. 2, a fragmentary longitudinal vertical sectional taken on the line 2—2 of FIG. 1 showing the integral piping of the base and the screwably removable connection thereto of the water tube and the plant stems;

FIG. 3, a lateral vertical sectional view taken on the line 3—3 of FIG. 2 showing the rectangular cross-section of the water passageway through the base;

FIG. 4, a fragmentary exploded view of the base and associated pipe fittings;

FIG. 5, a fragmentary exploded view of a misting flower of the invention;

FIG. 6, a longitudinal vertical sectional view taken on the line 6—6 of FIG. 1 showing the misting flower of FIG. 5 in assembled condition;

FIG. 7, a fragmentary side elevational view of a second embodiment misting plant with the base thereof partially broken away to show the tube which carries the water;

FIG. 8, a longitudinal vertical sectional view showing a second version misting flower; and FIG. 9, a rear elevational view of a third embodiment misting plant of the invention comprising a cactus plant.

DETAILED DESCRIPTION OF THE ILLUSTRATED EMBODIMENTS

Referring to FIGS. 1–6, an evaporative cooling unit of the invention includes a base in the form of a flower pot 20 with water conduits 21, 22, and 23 forming flower stalks extending from pot 20 and having artificial flowers 24, 25, and 26, respectively, attached to the upper ends of the stalks. The unit forms a decorative flower display that disguises its function as a cooling unit.

Base 20 may be molded of plastic material and is molded to include a water inlet portion 28 which extends outwardly from the back of the pot 20 as shown in FIGS. 1, 2, and 4. A horizontal passage 29 extends from inlet portion 28 to a central upstanding portion 30 having an internally threaded end portion 31. A plug 32 is screwed into threaded end portion 31. The lower ends of rigid or malleable conduits 21, 22, and 23 are secured in holes 34, 35, and 36 in plug 32, such as by a friction fit, crimping, or use of adhesives, with such conduits extending from plug 32 upwardly out of pot 20. An internally threaded sleeve 38 with ring 39 snaps over the end of inlet portion 28 so that ring 39 is rotatably received in annular groove 40 of inlet portion 28. This holds sleeve 38 on inlet portion 28. The threads in sleeve 38 can be of various types depending upon the water source to which the cooling unit is to be connected. Such threads may conveniently be female hose threads to mate with the male end of a normal garden hose 41. Flower pot 20 may be filled with a filler material 42, such as a plastic foam material or with earth or potting soil. This filler material 42 covers plug 32 so that it appears that the stalks formed by conduits 21, 22, and 23 extend from earth in the pot.

Flowers 24, 25, and 26 are formed from a molded rear core 50, molded front core 51, and petal disks 52 and 53 sandwiched between front and rear cores 51 and 50, respectively, FIGS. 5 and 6. Generally two petal disks 52 and 53 are used, but a single petal disk or more than two petal disks could be used. Front and rear cores 51 and 50 are held together by a stem 54 which is snapped into center opening 55 of front core 51 with front core central flange 56 snapping into annular groove 57 to secure stem 54 to front core 51. Stem 54 extends through hole 58 in rear core 50 with rear core 50 frictionally held to stem 54. The end of stem 54 includes several annular barbs 59 which extend into conduit 22 and hold stem 54 and flower 25 in the end of conduit 22. A misting nozzle 60 is threaded into the other end of stem 54. Flowers 24 and 26 are constructed similarly.

To finish the display, sleeves 64 on the ends of molded leaf representations 65 are slid over and along tubes 21, 22, and 23 to represent and give the appearance of leaves extending from the stalks created by conduits 21, 22, and 23. If conduits 21, 22, and 23 are malleable, the user can bend them into desired positions and aim the misting nozzle as desired.

When a source of pressurized water, such as garden hose 41, is attached to inlet portion 28, water flows from inlet 28, through passage 29 and conduits 21, 22, and 23 to flowers 24, 25, and 26, where the water is misted by misting nozzles 60 in each of the flower 24, 25, and 26. This mist sprays out of the flower into the air around the flower to cool the air by evaporation.

FIG. 8 shows an alternate construction of the flowers. In the embodiment of FIG. 8, the flower again has a rear core 70 and front core 71, with petal rings 72 and 73 sandwiched therebetween. With this embodiment, however, stem 74 is molded as an integral part of front core 71, rather than as a separate piece. Annular barbs 75 and misting nozzle 76 are as previously described.

FIG. 7 shows an embodiment wherein the base is in the form of a flower pot 80 with hole 81 in its lower rear. A flexible tube or conduit 82 extends through hole 81 and has a fitting 83 for attachment to a source of pressurized water, such as a garden hose, attached to an end thereof. Tube 82 is molded to split into a plurality of tubes, such as three tubes 84, 85, and 86, as shown. Which form the stalks for the flowers of the display. Since the tubes are flexible, malleable wires 87, 88, and 89 are positioned in tubes 84, 85, and 86 and extend into tube 82, to provide some rigidity to the tubes so that they will stand up to extend upwardly from flower pot 80 and support flowers, not shown, attached to the upper ends of tubes 84, 85 and 86. Flower pot 80 can be filled with filler material 90, as desired.

FIG. 9 shows a flower pot 95 similar to that shown in FIGS. 1–6, having fitting 97 to connect to a hose or other source of pressurized water and passage 97 extending from fitting 96 to central upstanding portion 98. Conduits 100, 101, and 102 are secured in plug 103 screwed into threaded portion 104 of central upstanding portion 98. In this embodiment, however, conduits 100, 101, and 102 do not represent flower stalks, but are located inside a molded decorative structure 105, here shown in the form of a three arm cactus. Misting nozzles 106, 107, and 108 are secured in the ends of conduits 100, 101, and 102, respectively, and are mounted in desired positions in the molded decorative structure. With molded decorative structure 105 supporting conduits 100, 101, and 102, such conduits can be flexible tubing, such as flexible plastic tubing, having no support of their own. Alternatively, decorative structure 105 could have the conduits 100, 101, and 102 internally and integrally molded therein to be attached to plug 103, or can have a threaded bottom portion molded in that can be screwed directly into threaded portion 104 of central upstanding portion 98 in place of plug 103. Molded decorative structure 105 can take many forms, and a user could have several variations and such user could switch between decorative structures as desired. As with prior embodiments, flower pot 95 can be filled with filler material 110.

While various specific constructions of decorative structures, flowers, and bases have been shown, various other constructions could be used. Almost any of the various artificial flowers currently available could be used as flowers as long as misting nozzles can be incorporated thereinto or can be attached thereto. Also various misting nozzles as available could be used. In addition, while in the embodiments shown all flower in the decorative structure having misting nozzles, a decorative structure could have a plurality of flowers or other features, such as catus arms, where only one or some, but not all, have misting nozzles.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. An evaporative cooling unit comprising:

a base;

a decorative structure extending from the base;

a water conduit extending through the base and into the decorative structure and having a base end and at least one decorative structure end;

a fitting on the base end for attachment to a source of pressurized water; and a misting flower as part of the decorative structure, said misting flower comprising:

a stem having an inlet end adapted to be connected to a decorative structure end of the at least one decorative structure end of the water conduit and an outlet end;

a misting nozzle secured to the outlet end of the stem; and flower structure secured to and extending from the stem.

2. An evaporative cooling unit according to claim 1, wherein the flower structure includes a front core, a rear core, and petals extending outwardly beyond the front and rear cores.

3. An evaporative cooling unit according to claim 2, wherein the petals are formed by at least one petal disk having a center ring portion from which the petals extend, the center ring portion being sandwiched and held between the front core and the rear core so the petals extend beyond the front core and the rear core.

4. An evaporative cooling unit according to claim 3, wherein the front core is secured to the stem.

5. An evaporative cooling unit according to claim 4, wherein the rear core is secured to the stem.

6. An evaporative cooling urn claim 3, wherein to the front core is formed integrally with the stem.

7. An evaporative cooling unit according to claim 1, wherein the inlet end includes barbs and is configured to fit into the decorative structure end of the at least one decorative structure end of the water conduit to which it is adapted to be connected.

* * * * *